US009162816B1

(12) United States Patent
Hardy et al.

(10) Patent No.: US 9,162,816 B1
(45) Date of Patent: Oct. 20, 2015

(54) DOUBLE TANK ASSEMBLY WITH SHIPPING NOTCHES AND LIFTING EYES

(75) Inventors: Robert E. Hardy, Hospers, IA (US); Dean Johnson, Hospers, IA (US)

(73) Assignee: DenHartog Industries, Hospers, IA (US)

( * ) Notice: Subject to any disclaimer, the term of this patent is extended or adjusted under 35 U.S.C. 154(b) by 143 days.

(21) Appl. No.: 13/348,969

(22) Filed: Jan. 12, 2012

(51) Int. Cl.
*B65D 90/24* (2006.01)
*B65D 88/02* (2006.01)

(52) U.S. Cl.
CPC ..... *B65D 88/022* (2013.01)

(58) Field of Classification Search
CPC ..... B65D 11/16; B65D 21/0233; B65D 2577/045; B65D 88/1625; B65D 85/84; B65D 90/22; F17C 2203/018
USPC ..... 220/23.87, 23.89, 560.03, 23.83, 560, 220/23.86, 4.26, 565, 566, 567, 567.2, 4.12, 220/4.13; 588/249; 137/312, 264; 206/561, 206/564
See application file for complete search history.

(56) References Cited

U.S. PATENT DOCUMENTS

| | | | | | |
|---|---|---|---|---|---|
| 193,010 | A | * | 7/1877 | Lucas | 220/592.28 |
| 1,016,974 | A | | 2/1912 | Steel | |
| 1,330,868 | A | * | 2/1920 | Harrison | 99/403 |
| 4,331,127 | A | * | 5/1982 | Grosso | 126/378.1 |
| 4,595,113 | A | | 6/1986 | Fafflok et al. | |
| 4,708,258 | A | | 11/1987 | Shaw et al. | |
| 4,815,621 | A | | 3/1989 | Bartis | |
| 5,036,998 | A | | 8/1991 | Dunn | |
| 5,081,761 | A | | 1/1992 | Rinehart et al. | |
| 5,088,530 | A | | 2/1992 | Harp | |
| 5,179,971 | A | | 1/1993 | Jackson | |
| 5,197,601 | A | | 3/1993 | Sterett | |
| 5,203,386 | A | | 4/1993 | Harp | |
| 5,226,558 | A | | 7/1993 | Whitney et al. | |
| 5,249,684 | A | | 10/1993 | Sterett | |
| 5,285,914 | A | | 2/1994 | Del Zotto | |
| 5,287,986 | A | * | 2/1994 | Frost | 220/565 |
| 5,333,752 | A | * | 8/1994 | Harding, Jr. | 220/565 |
| 5,353,951 | A | | 10/1994 | Kusz et al. | |
| 5,494,183 | A | | 2/1996 | Sharp | |
| 5,538,052 | A | | 7/1996 | Harp | |
| 5,564,588 | A | | 10/1996 | Reese | |
| 5,582,310 | A | | 12/1996 | Del Zotto | |
| 5,590,803 | A | | 1/1997 | Kaempen | |
| 5,632,403 | A | | 5/1997 | Deng | |
| 5,664,313 | A | | 9/1997 | Palazzo | |
| 5,695,089 | A | | 12/1997 | Reese et al. | |
| 5,711,632 | A | | 1/1998 | Garrahan | |

(Continued)

*Primary Examiner* — Mickey Yu
*Assistant Examiner* — Allan Stevens
(74) *Attorney, Agent, or Firm* — McKee, Voorhees & Sease, PLC

(57) ABSTRACT

A dual wall storage container assembly is provided for storing liquids. The container includes a one-piece, molded inner tank which can be installed and removed from a molded outer tank. Notches are provided adjacent the bottom of the outer tank to align the inner tank within the outer tank. A horizontal shelf surrounds the mouth of the outer tank, with a horizontal shoulder on the top of the inner tank overlying the shelf. A seal is provided between the shelf and the shoulder to inhibit moisture migration. A drip edge is provided on the top outer perimeter of the inner tank to further inhibit moisture migration between the shelf and the shoulder. A tab on the shoulder is received in a notch in the shelf to preclude rotation between the nested tanks. Lifting flanges on the outer tank allow both tanks to be lifted simultaneously while nested together.

10 Claims, 6 Drawing Sheets

(56) References Cited

U.S. PATENT DOCUMENTS

| | | | | |
|---|---|---|---|---|
| 5,809,650 | A | 9/1998 | Reese et al. | |
| 6,085,927 | A | 7/2000 | Kusz | |
| 6,206,228 | B1 | 3/2001 | Roth | |
| 6,474,496 | B1 * | 11/2002 | Garton | 220/565 |
| 7,086,326 | B2 * | 8/2006 | Yokoyama | 99/413 |
| 7,275,651 | B2 | 10/2007 | Morales et al. | |
| 7,798,951 | B2 * | 9/2010 | Chang | 588/249 |
| 7,815,046 | B2 | 10/2010 | Sansoucy et al. | |
| 2007/0056975 | A1 | 3/2007 | Long et al. | |
| 2009/0255927 | A1 | 10/2009 | Flecknoe-Brown | |
| 2009/0266821 | A1 * | 10/2009 | Johnson et al. | 220/565 |
| 2011/0011881 | A1 | 1/2011 | Sansoucy et al. | |
| 2011/0315689 | A1 * | 12/2011 | Meints et al. | 220/500 |

* cited by examiner

DOUBLE TANK ASSEMBLY WITH SHIPPING NOTCHES AND LIFTING EYES

BACKGROUND OF THE INVENTION

Various types of storage containers are well-known for containing liquids, including agricultural chemicals. Some storage containers include double walls which precludes spillage or leakage of the liquid if the outer wall is damaged, such as a puncture, without damage to the interior wall of the container. If there is a leak in the inner tank, the liquid is captured by the outer tank. Some double walled containers are fabricated as a single unit in which the inner and outer walls cannot be separated. Other double wall containers include separate inner and outer tanks which nest together. However, the structure and manufacture of all these double wall containers is relatively complex, and thus costly.

In designing and manufacturing plastic molded tanks, it is important to maintain the integrity of the tank, including maximum strength and minimal stresses. Molded plastic tanks with continuous, non-interrupted sidewalls have greater strength and less stress points than tanks having depressions or other formations in the sidewall. Such depressions increase the circumferential or hoop stress of the tank sidewall, and thus weaken the sidewall strength. As the level or volume of liquid or particulate material contained in a tank increases or raises, the forces generated by such contents increases. Thus, maintaining maximum sidewall strength and minimizing hoop stress becomes more important along the height of a cylindrical tank. Interruptions in the cylindrical hoop created by depressions in the sidewall may cause the sidewall to bulge, and eventually fail, under the force of the tank contents.

Accordingly, a primary objective of the present invention is the provision of an improved storage container for liquids having separate inner and outer tanks.

Another objective of the present invention is the provision of an improved storage container for liquids which has a double walled construction.

A further objective of the present invention is the provision of an improved storage container for liquids having an inner tank which can be removably nested within an outer tank.

Still another objective of the present invention is the provision of a dual tank assembly having notches in the outer tank to engage, support and align the inner tank when the nested tanks are in a horizontal shipping position.

Another objective of the present invention is the provision of nesting inner and outer tanks wherein the outer tank has lifting eyes for receiving hooks to lift the nested tanks together.

A further objective of the present invention is the provision of an improved double tank assembly wherein the outer tank has short alignment notches adjacent the bottom which substantially maintain the hoop strength of the cylindrical tank sidewall substantially along the height of the sidewall.

Still another objective of the present invention is the provision of a dual tank assembly for storing liquids wherein the sidewall of the outer tank has a cylindrical hoop extending uninterrupted substantially from the top of the tank to the bottom of the tank.

Yet another objective of the present invention is the provision of an improved storage container for liquids wherein an inner tank has a top rim which overhangs an upper shelf or shoulder on the lower tank.

Another objective of the present invention is the provision of an improved storage container having separable nesting inner and outer tanks with means to preclude rotation of the tanks relative to one another when assembled together.

A further objective of the present invention is the provision of an improved storage container for liquids having dual inner and outer tanks which are molded plastic.

Another objective of the present invention is the provision of an improved storage container for liquids wherein an inner tank has a bottom, a sidewall and a top molded as one piece and an outer molded tank having a bottom, a sidewall, and an upper open mouth for receiving the inner tank.

A further objective of the present invention is the provision of an improved storage container for liquids which is economical to manufacture and durable and safe in use.

These and other objectives will become apparent from the following description of the invention.

SUMMARY OF THE INVENTION

The improved storage container of the present invention includes a molded outer tank having a bottom, a sidewall and an upper open mouth, and a molded inner tank having a bottom, a sidewall, and a top. The inner tank is separate from the outer tank and can be removably inserted through the open mouth of the outer tank. The outer tank includes a plurality of notches formed in the sidewall adjacent the bottom of the tank. The notches are adapted to engage the bottom of the inner tank and maintain proper positioning of the inner tank within the outer tank, even when the tanks are laid on their sides in a horizontal orientation for shipping. The outer tank also has a plurality of spaced apart lifting eyes adapted to receive hooks or other lifting mechanisms so that the two tanks can be lifted together while nested. The top of the inner tank has a horizontal, downwardly facing rim which overlies an upper horizontal shelf or shoulder surrounding the mouth of the outer tank. A seal may be provided between the rim and the shelf. A capillary drip edge is provided on the outer perimeter of the rim of the inner tank to inhibit rain and other liquids from migrating between the rim and the shelf into the space between the outer tank and the inner tank. An indexing tab is provided on the inner tank and registers with a corresponding notch on the outer tank to preclude rotation of the inner tank relative to the outer tank.

DETAILED DESCRIPTION OF THE PREFERRED EMBODIMENTS

Figure 1:
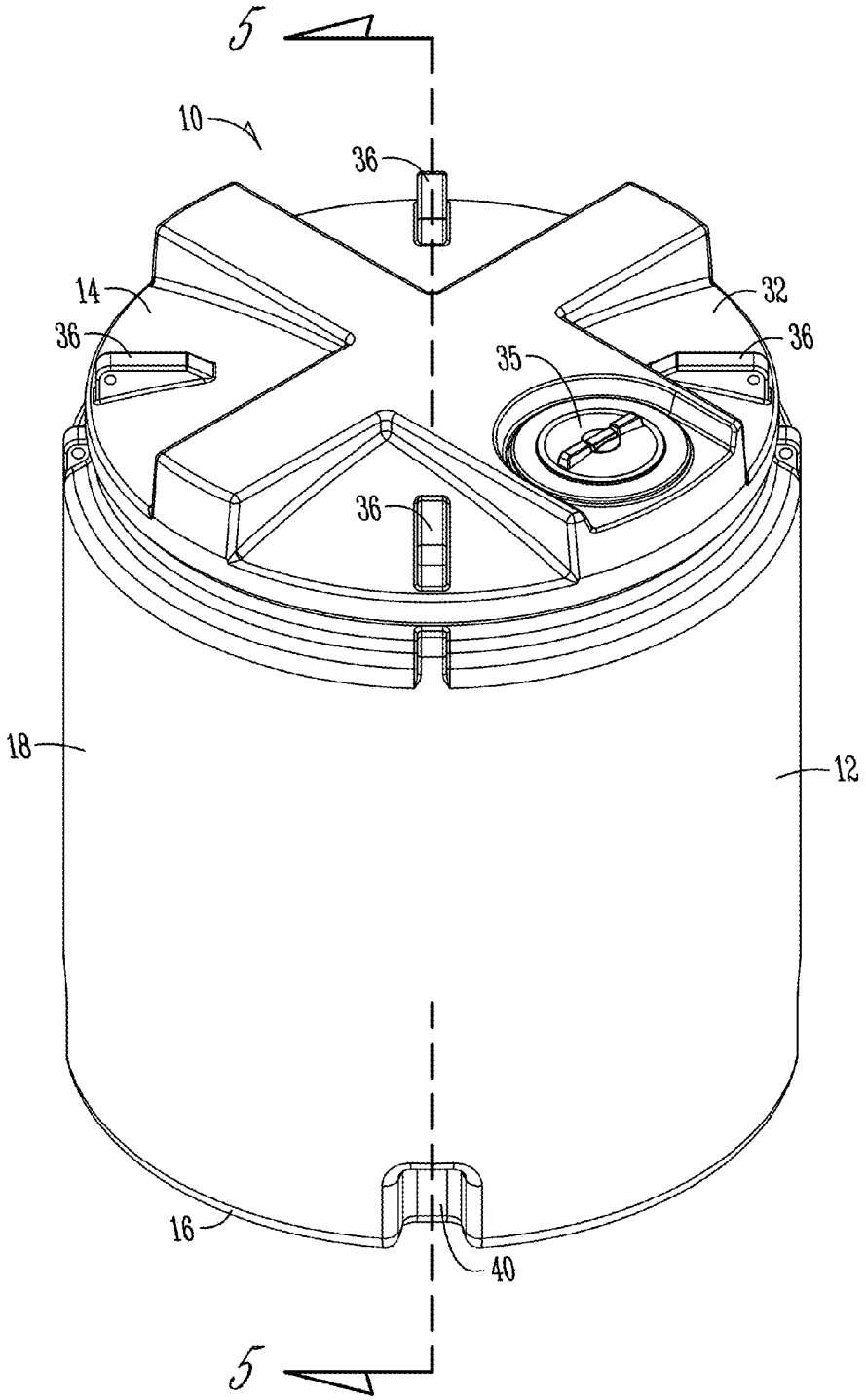
FIG. 1 is a perspective view of one embodiment of the improved storage container for liquids according to the present invention with the inner and outer tanks nested together.
Figure 2:
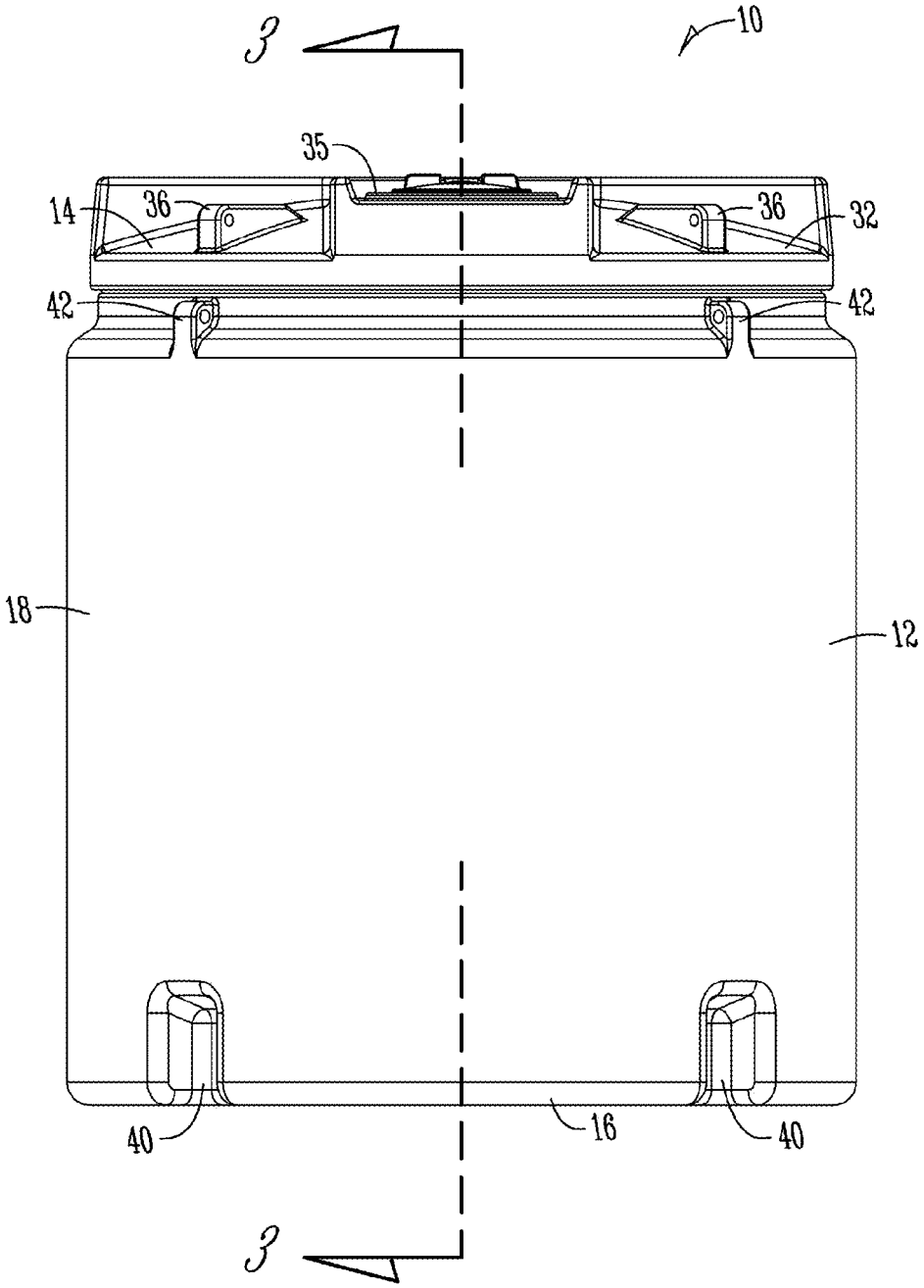
FIG. 2 is a side elevation view of the container of FIG. 1 showing the inner tank partially separated from the outer tank.
Figure 3:
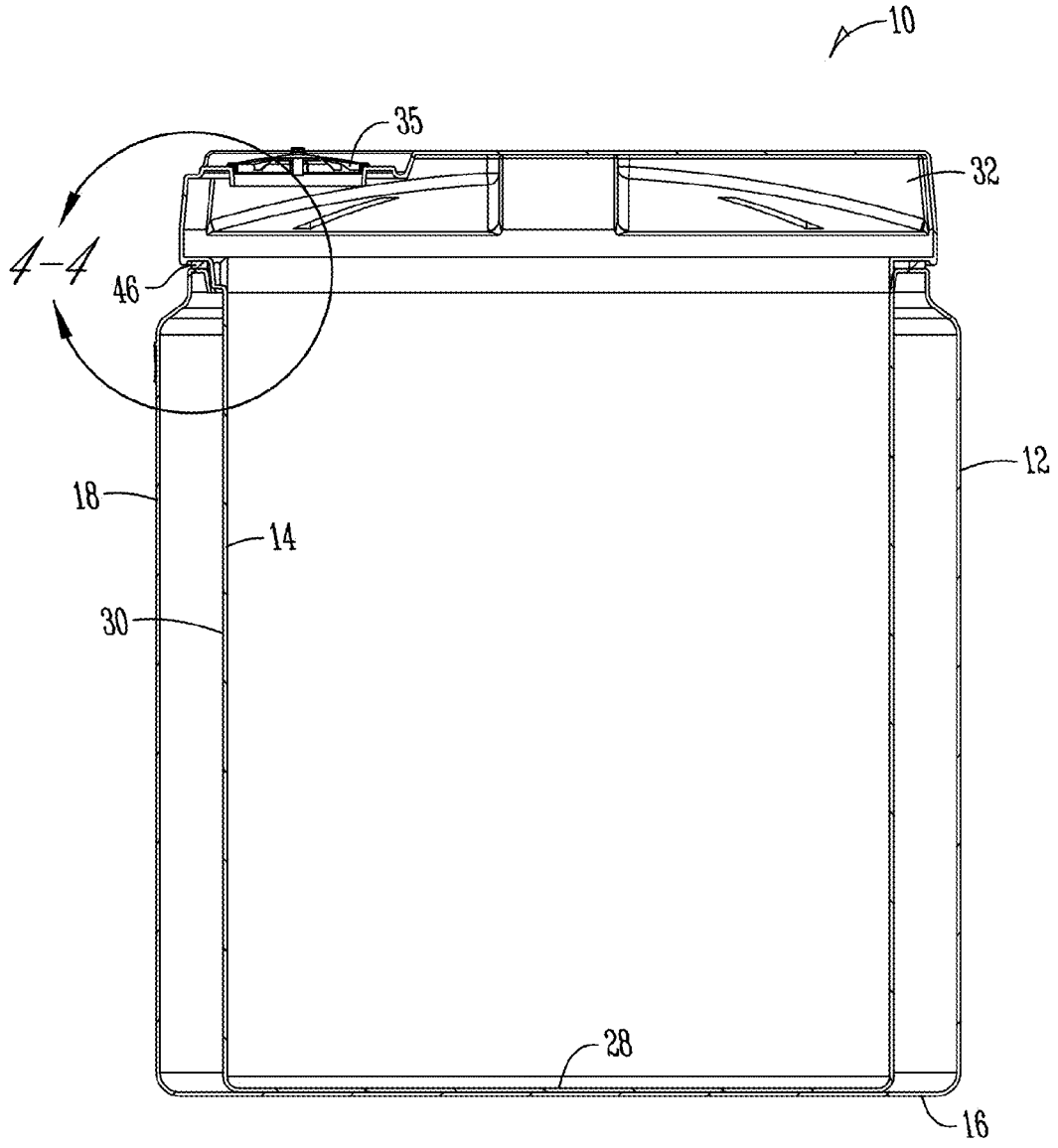
FIG. 3 is a sectional view of the tank taken along lines 3-3 of FIG. 2.

The Figures of the improved storage container assembly of the present invention is designated by the reference numeral 10. The container or assembly 10 includes and outer tank 12 and an inner tank 14, each of which is molded as a one-piece unit. The outer tank 12 includes a bottom wall 16 and a sidewall 18. The upper end of the sidewall 18 preferably terminates in reduced-diameter neck 20 with an upper open mouth 22, though it is understood that the tank 12 does not require a reduced diameter for the neck 20. A horizontal shelf or shoulder 24 extends around the perimeter of the mouth 22. A lip 26 extends downwardly from the shelf 24 to provide additional strength and integrity for the shelf 24.

The inner tank 14 includes a bottom wall 28, a sidewall 30, and a mushroom-type top 32. The top 32 includes a downwardly facing horizontal rim or shoulder 34. One or more openings may be provided in the top 32 for introducing and removing liquid to and from the interior of the tank 14. The opening in the top 32 may be covered or closed in any convenient means, such as by a threaded cap 35 with a seal 37 between the top 32 and cap 35. The cap 35 may also have a removable plug 39. Lifting flanges 36 are formed in the top 32 of the inner tank 14 and are adapted to receive hooks on chains or straps for lifting the inner tank 14 during installation or removal from the outer tank 12.

The outer tank 12 includes a plurality of notches 40 adjacent the bottom 16 of the tank 12. The notches preferably have a relatively short height so as to substantially avoid any interruption of the sidewall 18 of the tank 12, thereby maintaining the structural integrity and the hoop strength of the sidewall 18. In the preferred embodiment shown in the figures, the height of the notches 40 are substantially equivalent to the width of the notches 40. The notches are adapted to engage the sidewall 30 of the inner tank 14 adjacent the bottom 28 thereof. Thus, when the inner tank 14 is nested within the outer tank 12, the notches 40 preclude relative movement between the tanks, even when the tanks 12, 14 are laid downwardly so that their longitudinal axes are horizontal, as commonly done for shipping the tank assembly 10. Preferably, there are four notches 40 in the outer tank 12, spaced 90° apart from one another.

The outer tank 12 also has a plurality of spaced apart lifting flanges 42 adjacent the top of the tank, outside the mouth 22. Preferably, there are four lifting flanges 42 spaced 90° apart from one another. The flanges 42 include a hole adapted to receive hooks on chains or straps for lifting the outer tank 12, with or without the inner tank 14 nested therein.

Figure 4:
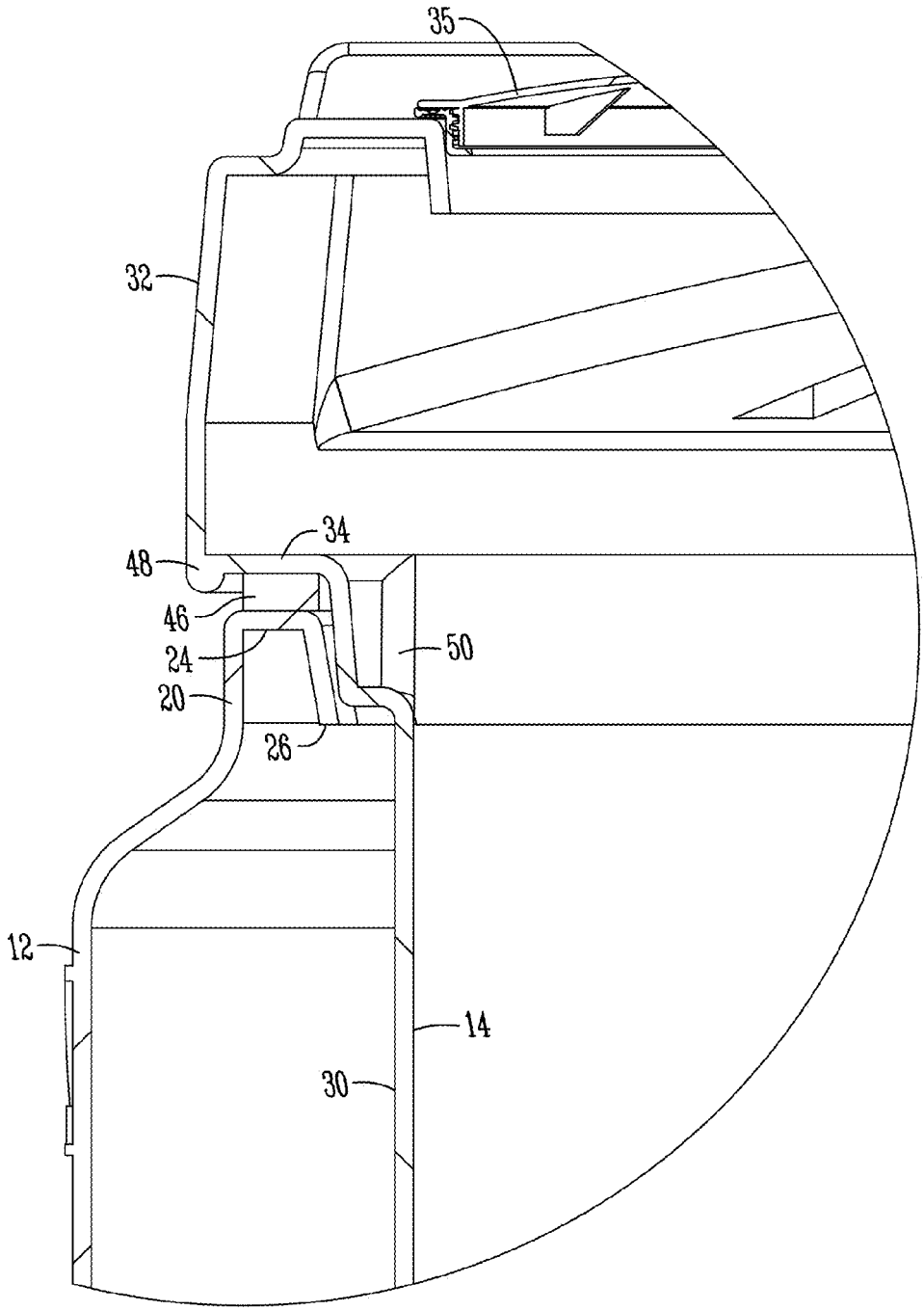
FIG. 4 is an enlarged sectional view taken on lines 4-4 of FIG. 3, showing the overlapped shelf and shoulder of the outer and inner tanks, respectively, with the annular seal therebetween.
Figure 5:
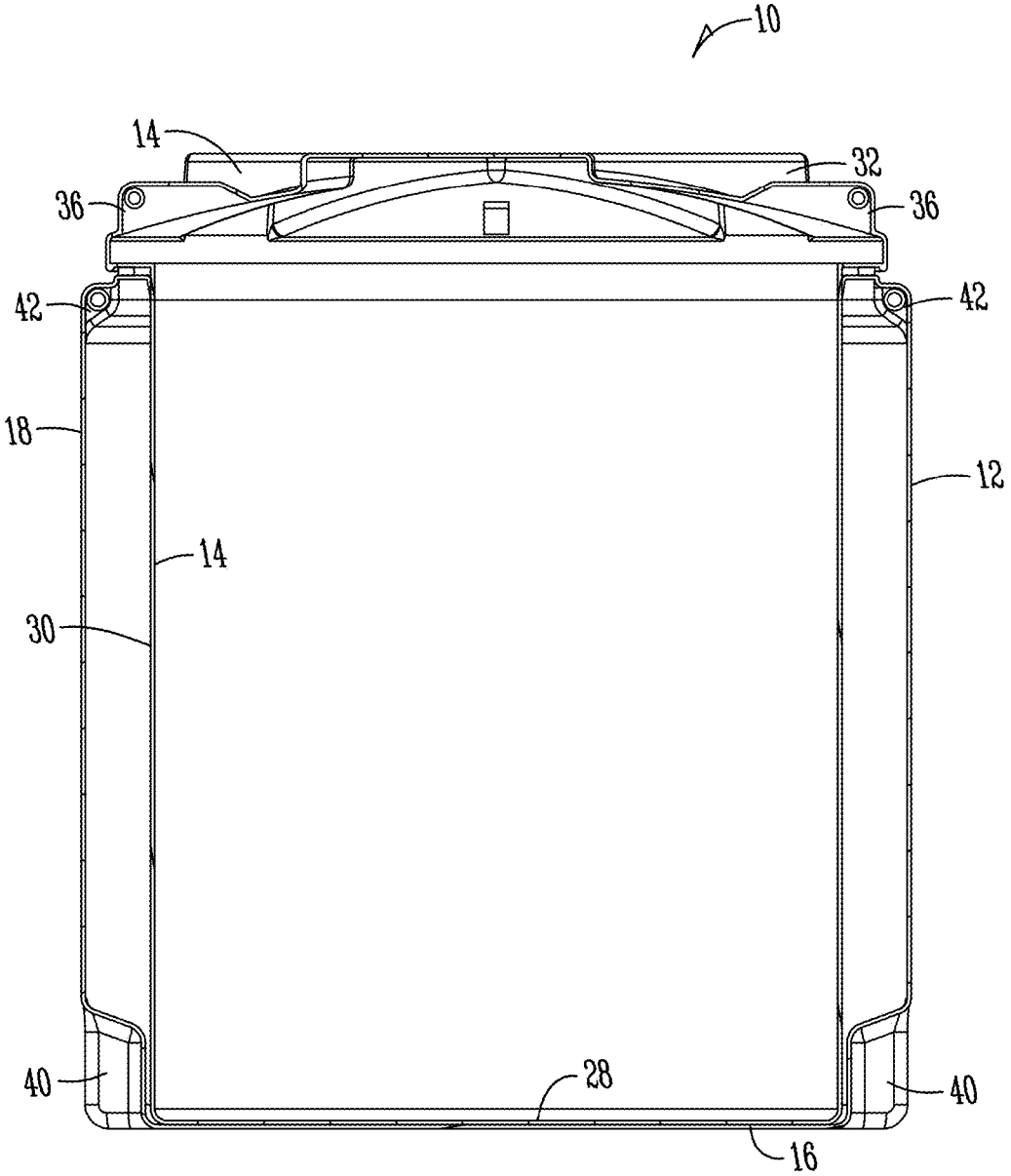
FIG. 5 is a sectional view of the tank taken along lines 5-5 of FIG. 1 showing the anti-rotation tab of the tanks.

An optional seal 46 may be provided for the container 10 between the shelf 24 of the outer tank 12 and the rim 34 of the inner tank 14. The seal 46 may be formed of the appropriate material, such as adhesive backed foam, to seal the joint between the shelf 24 and the rim 34. In FIG. 4, the seal 46 is shown in a non-compressed state, though it is understood that the weight of the tank 14 and the liquid therein will normally compress the seal 46. As an alternative to the foam ring, the seal may be formed by a caulk bead applied to the juncture of the shelf 24 and rim 34.

The inner tank 14 also includes a drip edge 48 on the outer perimeter of the top 32 to inhibit migration of rain or other moisture between the shelf 24 and the rim 34.

Figure 6:
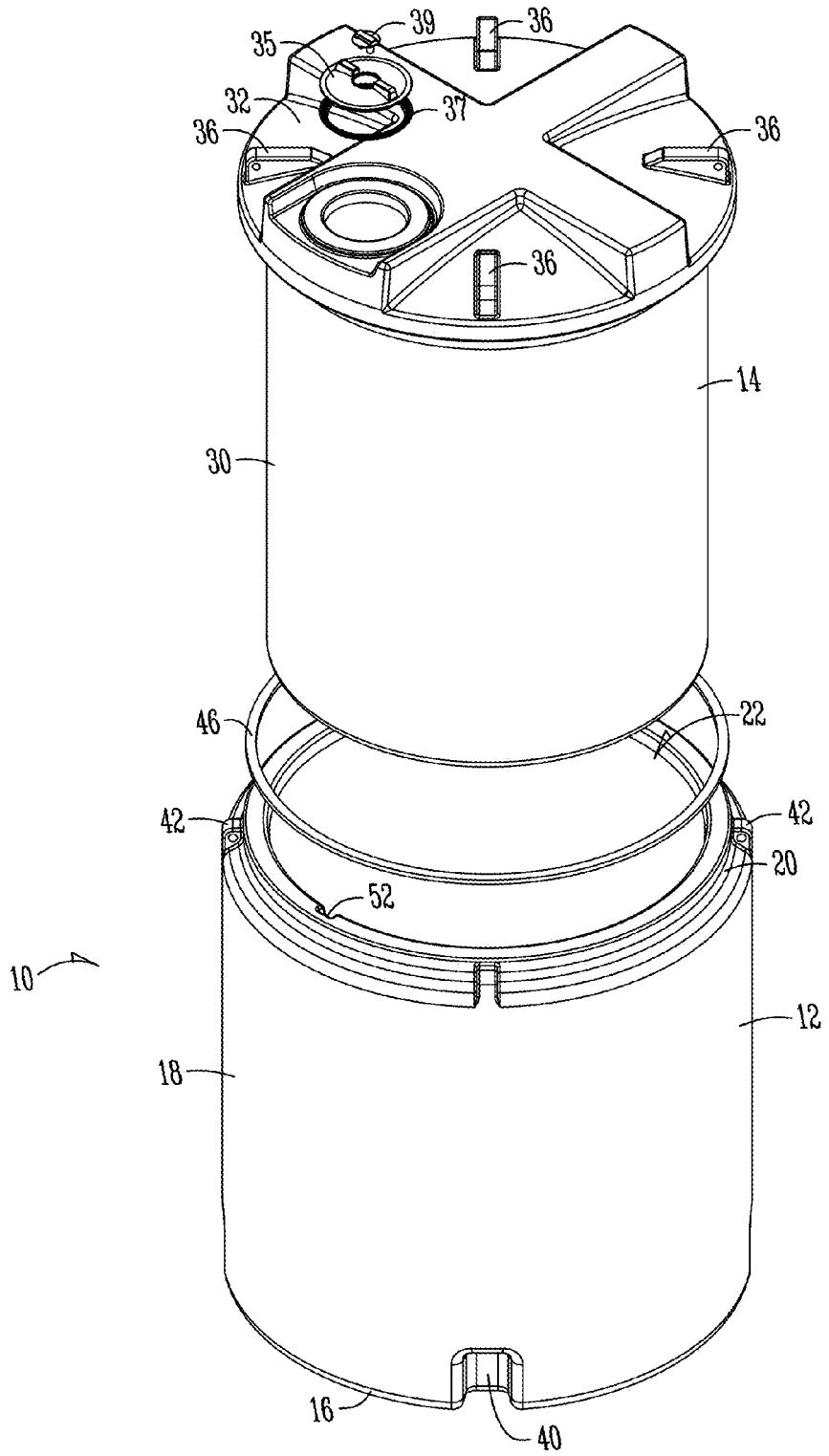
FIG. 6 is an exploded view of the tanks.

Anti-rotation means may also be provided on the tanks 12 and 14 to preclude rotation of the tanks when nested together. For example, as seen in FIG. 6, one or more tabs 50 on the shoulder 34 align or register with corresponding recesses or notches 52 on the shelf 24. When the tabs 50 are received in the notches 52, the inner tank 14 is locked against rotation relative to the outer tank 12. This anti-rotation lock is useful when a drain fitting is provided between the tank sidewalls 18, 30. It is understood that the tab 50 and notch 52 can be reversed on the shelf 24 and rim 34, respectively. The tab 50 and notch 52 reside radially inwardly from the annular seal 46.

With the container 10 of the present invention, the inner tank 12 may be filled before or after the inner tank 14 is positioned within the outer tank 12. Thus, the outer tank 12 may be used with different inner tanks 14. The outer and inner tanks form a double wall construction for the container 10 so as to protect the contents of the inner tank even if the outer tank is damaged. Also, if the inner tank 14 has a leak, any liquid draining from the inner tank will be captured in the space between the inner tank 14 and the outer tank 12, and thereby prevent contamination of the ground or area outside the container 10.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A dual tank assembly for storing liquid chemicals, comprising:

a molded plastic outer tank having a bottom, a cylindrical sidewall, and a top with an open mouth;

a molded plastic inner tank having a bottom, a cylindrical sidewall, and a top cover integrally formed with the sidewall and extending across the inner tank;

the inner tank being removably nested inside the outer tank with a space between the sidewalls of the inner and outer tanks;

a first set of flanges integrally molded on the top cover of the inner tank for lifting the inner tank separate from the outer tank;

a second set of flanges integrally molded on the outer tank for lifting the nested tanks;

the top cover having a perimeter edge defining a diameter, and the first set of lifting flanges on the top cover residing radially inwardly from the perimeter edge;

the sidewall of the outer tank having a diameter greater than the diameter of the inner tank top cover;

the second set of lifting flanges residing radially inwardly from the outer tank cylindrical sidewall and radially outwardly from the perimeter edge of the top cover; and wherein when the tanks are nested for liquid chemical storage, the outer tank is normally empty and the liquid chemical is stored in the inner tank.

2. The dual tank assembly of claim 1 wherein the second set of flanges are equally spaced around the outer tank.

3. The dual tank assembly of claim 1 wherein the second set of flanges are adjacent the top of the outer tank.

4. The dual tank assembly of claim 1 wherein the sidewall of the outer tank has a cylindrical hoop extending uninterrupted from the top downwardly substantially to the bottom.

5. The dual tank assembly of claim 1 wherein the outer tank has a reduced diameter neck, and the second set of flanges reside adjacent the neck.

6. The dual tank assembly of claim 1 wherein the second set of flanges are independent from the inner tank.

7. The dual tank assembly of claim 1 wherein the second set of flanges do not extend above the top of the outer tank.

8. The dual tank assembly of claim 1 wherein the top cover of the inner tank has a fill opening, and further comprising a removable cap to close the fill opening.

9. The dual tank assembly of claim 1 wherein the sidewalls of the tanks are substantially parallel to one another when the tanks are nested.

10. The dual tank assembly of claim 1 wherein the bottom of the inner tank rests upon the bottom of the outer tank when the tanks are nested.

* * * * *